US006621230B2

(12) United States Patent
Lim et al.

(10) Patent No.: US 6,621,230 B2
(45) Date of Patent: Sep. 16, 2003

(54) METHOD FOR OPERATING PDP

(75) Inventors: Geun Soo Lim, Kyonggi-do (KR); Jeong Pil Choi, Kyonggi-do (KR); Hwan Yu Kim, Kyonggi-do (KR); Tae Hyung Kim, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/138,691

(22) Filed: May 9, 2002

(65) Prior Publication Data

US 2002/0195970 A1 Dec. 26, 2002

(30) Foreign Application Priority Data

May 10, 2001 (KR) ..... 2001-25376

(51) Int. Cl.[7] ..... G09G 3/28

(52) U.S. Cl. ..... 315/169.3; 315/169.4; 345/60; 345/63

(58) Field of Search ..... 315/169.3, 169.4; 345/60, 63

(56) References Cited

U.S. PATENT DOCUMENTS 6,466,187 B1 * 10/2002 Moon ..... 345/63

* cited by examiner

*Primary Examiner*—David Vu
(74) *Attorney, Agent, or Firm*—Lee & Hong

(57) ABSTRACT

The present invention relates to a plasma display panel, and more particularly, to a method for operating a plasma display panel (PDP), in which a pulse applied to an electrode in the PDP is controlled according to a gray scale of a picture to be displayed. The method for operating a PDP having three electrodes, the PDP for displaying one frame which includes a plurality of sub-fields each having a reset period, an addressing period, and a sustain period in view of time, the method including the steps of applying a fixed number of pulses in a fixed frequency in each period for displaying an image of a particular grey scale, and adjusting a number of pulses and/or a frequency applied in each period for displaying an image having a grey scale different from the particular grey scale.

23 Claims, 11 Drawing Sheets

METHOD FOR OPERATING PDP

This application claims the benefit of the Korean Application No. P2001-0025376 filed on May 10, 2001, which is hereby incorporated by reference.

BACKGROUND OF THE INVENTION

1. Field of the Invention

The present invention relates to a plasma display panel, and more particularly, to a method for operating a plasma display panel (PDP), in which a pulse applied to an electrode in the PDP is controlled according to a gray scale of a picture to be displayed.

2. Background of the Related Art

Of the different flat board type display devices, the PDP is paid attention as a large sized panel because the PDP has many advantages suitable for fabricating a large sized display device.

Most typically, the PDP is provided with 3 electrodes and is driven by an AC voltage, called as an AC surface discharge type PDP. FIG. 1 illustrates a perspective view of a discharge cell of a related art AC PDP of surface discharge type having 3-electrodes.

Referring to FIG. 1, the discharge cell is provided with a scan electrode 12Y and a common sustain electrode 12Z formed on a front substrate 10, and an address electrode 20X formed on a back substrate 18.

There are a front dielectric 14 and a protective layer 16 stacked on the front substrate 10 having the scan electrode 12Y and the common sustain electrode 12Z formed in parallel. The front dielectric 14 is provided for accumulation of wall charge generated in plasma discharge.

The protective layer is provided for protecting the front dielectric 14 from damage caused by sputtering of the plasma discharge, and enhancing a secondary electron emission efficiency. In general, the protective layer 16 is formed of magnesium oxide MgO.

There are a back dielectric 22 and a barrier rib 24 on the back substrate 18 having the address electrode 20X formed thereon. There is a phosphors 26 coated on surfaces of the back dielectric 22 and the barrier rib 24. The address electrode 20X is formed in a direction perpendicular both to the scan electrode 12Y and the common sustain electrode 12Z. The phosphors 26 are excited by UV ray emitted in the plasma discharge, to emit one of red, green, and blue visible light. There is an inert gas injected into a discharge space between the two substrates and the barrier rib.

Referring to FIG. 2, there are a matrix of the discharge cells arranged in the PDP.

Referring to FIG. 2, the discharge cell 1 has a scan electrode line Y1, - - - , or Ym and a sustain electrode line Z1, - - - , or Zm running in parallel, and the discharge cell is provided in every part the two electrode lines Y1, - - - , and Ym and Z1, - - - , and Zm cross the address electrode lines X1, - - - , and Xn.

The scan electrode lines Y1, - - - , and Ym are operative in a sequence, and the common sustain electrode line Z1, - - - , and Zm are operative in common. The address electrode lines X1, - - - , Xn are operative with odd numbered lines and even numbered lines divided.

In the related art AC PDP of surface discharge type having 3-electrodes, an operation time period for displaying a particular grey scale of a frame is divided into sub-fields. In each of sub-field duration, a number of times of light emissions proportional to a weight value of a video data is progressed to display a grey scale.

As an example, referring to FIG. 3, when a picture of 8 bit data is displayed in 256 grey scales, one frame display duration (for an example, 1/60 seconds=approx. 16.7 msec) of each discharge cell 1 is divided into 8 sub-fields (SF1–SF8).

Each of the sub-fields (SF1–SF8) is again divided into a reset duration, an addressing duration, and a sustain duration, and each sustain duration of the sub-fields (SF1–SF8) has a time weight variably given in a ratio of $2^N$ (where N=0, 1, 2, 3, - - - , 7). That is, time weights in a ratio of 1:2:4:8:16:32:64:128 are given to the sub-fields SF1–SF8 starting from a first sub field SF1 to an eighth sub-field SF8.

FIG. 4 illustrates operation waveforms applied to respective electrodes in each sub field in FIG. 3.

Referring to FIG. 4, each of the sub fields in the related art PDP is operated, with the sub field divided into a reset duration, addressing duration, a sustain duration, and an erasure duration.

The reset duration is a duration for initializing the discharge cell. The address duration is a duration for making a selective address discharge according to a logical value of the video data. The sustain duration is a duration for sustaining an address discharge in a discharge cell. The erasure duration is a duration for erasing all discharges sustained in all the discharge cells.

In the erasure duration, a erasure pulse E is applied to the common sustain electrode Z, to erase the sustain discharge.

In the reset duration, a reset pulse RP is applied to the scan electrode Y to cause reset discharge at all discharge cells. Once, the reset discharge is occurred at all discharge cells, all the discharge cells are initialized.

In the addressing duration, a scan pulse SP is applied to the scan electrodes Y in succession, and a data pulse DP synchronous to the scan pulse SP is applied to the address electrodes X. In this instance, in the discharge cells having the scan pulse SP and the data pulse DP applied thereto, address discharges are occurred.

In the sustain duration, a sustain pulse SUSP1 or SUSP2 is applied to the scan electrodes Y and the common sustain electrodes Z, alternately. Upon application of the sustain pulse SUSP1 or SUSP2 alternately, sustain discharge is occurred at the discharge cells the address discharge is occurred therein for a preset duration.

The sustain pulse SUSP1, or SUSP2 has a pulse width in a range of approx. 2–3 $\mu$s. The sustain pulse S applied to the scan electrode Y at first has a pulse width in a range of 5 $\mu$s so as to cause the sustain discharge easily.

A number of the sustain pulses SUSP1, or SUSP2 is increased for each sub field separately for displaying a picture in preset grey scales. For an example, the first sub field has two sustain pulses SUSP1 or SUSP2, and the second sub field has four sustain pulses SUSP1 or SUSP2. The third sub field has eight sustain pulses SUSP1 or SUSP2. Thus, the related art PDP controls the number of sustain pulses SUSP1 SUSP2, for meeting required grey scales.

In the meantime, referring to FIG. 5, for obtaining a stead distribution of optical waveforms, it is required that at least 5 sustain pulses SUSP1, or SUSP2 are applied to the scan electrode Y and the common electrodes Z.

In more detail, an initial sustain pulse SUSP1 or SUSP2 causes a weak sustain discharge. Then, after an adequate wall charge is formed by several times of following sustain discharges, steady sustain discharges are occurred. Thus, the initial sustain discharge can not provide an adequate luminance.

Due to such discharge characteristics, sub fields that are required to display pictures in low grey scales can not obtain luminances consistent to the grey scales. In other words, the instable sustain discharge causes an erratic discharge in displaying a picture of a low grey scale.

Particularly, when an entire screen is displayed in low grey scales, the erratic discharge causes blinking of the screen, that deteriorates a picture quality. This blinking becomes the worse, as the addressing duration is the shorter, i.e., when the wall charge is not formed adequately during the addressing.

In the meantime, a high voltage may be applied in the addressing duration for prevention of the picture quality deterioration. That is, a voltage high in proportion to a reduction of the addressing duration may be applied for forming an adequate wall charge at the discharge cell. However, the application of the high voltage in the addressing duration requires a high voltage data drive IC (Integrated Circuit). Moreover, the high voltage data drive IC, not only consumes much power, but also high installation cost. In conclusion, what is required is a method for displaying a picture of lower grey scales while the voltage in the related art is kept.

SUMMARY OF THE INVENTION

Accordingly, the present invention is directed to a method for operating a PDP that substantially obviates one or more of the problems due to limitations and disadvantages of the related art.

An object of the present invention is to provide a method for operating a PDP, which permits to obtain an adequate luminance for grey scales required at sub fields that are required to display pictures in low grey scales, and suitable for displaying a picture of lower grey scales without deterioration of the picture without addition of an IC.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for operating a PDP having three electrodes, the PDP for displaying one frame which includes a plurality of sub-fields each having a reset period, an addressing period, and a sustain period in view of time, the method includes the steps of applying a fixed number of pulses in a fixed frequency in each period for displaying an image of a particular grey scale, and adjusting a number of pulses and/or a frequency applied in each period for displaying an image having a grey scale different from the particular grey scale.

More preferably, for a part of sub-field (A) to be displayed in a lower grey scale image, pulses of a lower frequency are applied to a scan electrode in the addressing period of the sub-fields (A).

For a part of sub-fields (A) to be displayed in a relatively lower grey scale image, a number of pulses more than a regular number are applied to the scan electrode and the sustain electrode alternately in the sustain period of the sub-fields (A).

For a part of sub-fields (A) to be displayed in relatively lower grey scale images, pulses of a lower frequency are applied to the scan electrode and the sustain electrode alternately in the sustain period of the sub-fields (A).

Of the sub-fields of the frame, a plurality of pulses are applied to the scan electrode in the reset period of the first sub-field.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Basically, the present invention relates to a method for operating a PDP having three electrodes. In an AC PDP of surface discharge type having 3-electrodes, an operation time period for displaying a particular grey scale of a frame is divided into sub-fields. Each of the sub-fields is divided into a reset period, an addressing period, and a sustain period.

In general, in operation of the PDP, a predetermined number of pulses of a predetermined frequency are applied to each electrode in each period of sub-field for displaying a picture of a particular grey scale.

In more detail, in general, one reset pulse RP is applied to a scan electrode Y in the reset period to cause a reset discharge at every discharge cell, thereby initializing all the discharge cells.

In the addressing period, the scan pulse SP is applied to the scan electrodes Y in succession, and on the same time, a data pulse DP synchronous to the scan pulse SP is applied to the address electrode X, to cause an address discharge at the discharge cells having the scan pulse SP and the data pulse DP applied thereto.

In the sustain period, the sustain pulse SUSP1 or SUSP2 is applied to the scan electrode Y and the common sustain electrode Z, alternately. When the sustain pulse SUSP1 or SUSP2 is applied alternately, a sustain discharge is sustained for a predetermined period at discharge cells at which the address discharge is occurred. The sustain pulse SUSP1 or SUSP2 has an approx. 2–3 μs width of frequency. The sustain pulse S applied to the scan electrode Y initially has an approx. 5 μs width of frequency for easy causing of the sustain discharge.

A number of sustain pulses SUSP1, or SUSP2 is increased for each sub field separately for displaying a picture in preset grey scales. In more detail, when a picture of 8 bit video data is displayed in 256 grey scales, one frame display period of each discharge cell is divided into 8 sub-fields (SF1–SF8), when the first sub field has two sustain pulses SUSP1 or SUSP2, the second sub field has four sustain pulses SUSP1 or SUSP2, and the third sub field has eight sustain pulses SUSP1 or SUSP2.

However, different from the foregoing description, the operation of PDP of the present invention has pulses applied in each period of each sub field, of which number and/or frequency is adjusted as follows before application, for displaying a picture of a lower scale.

Figure 6:
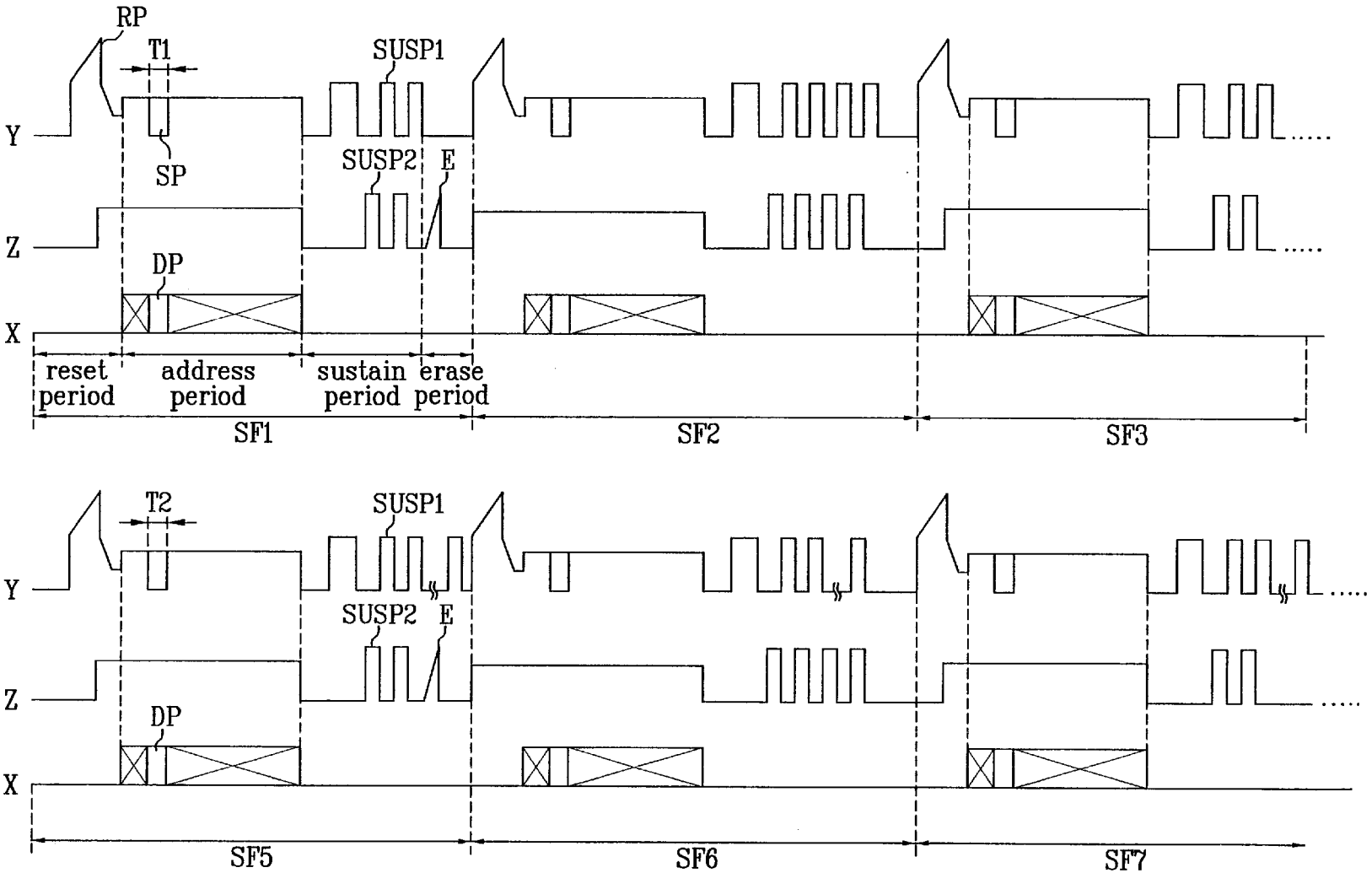
FIG. 6 illustrates waveforms for explaining a method for operating a PDP in accordance with a first preferred embodiment of the present invention.

First, in the present invention, for a part of sub-fields to be displayed in an image of a relatively lower grey scale, the scan pulse of a lower frequency is applied to the scan electrode in each addressing period of the sub-fields, and then, for the rest of the sub-fields except the sub-fields to be displayed in the image of a relatively lower grey scale, the scan pulse of a higher frequency is applied to the scan electrode in each addressing period of the sub-fields, which will be explained in detail with reference to FIG. 6.

Second, in the present invention, for the part of sub-fields to be displayed in the image of a relatively lower grey scale, the sustain pulses of a number greater than a preset number is applied to the scan electrode and the sustain electrode alternately in each sustain period of the sub-fields, which will be explained, with reference to FIG. 7.

Figure 8:
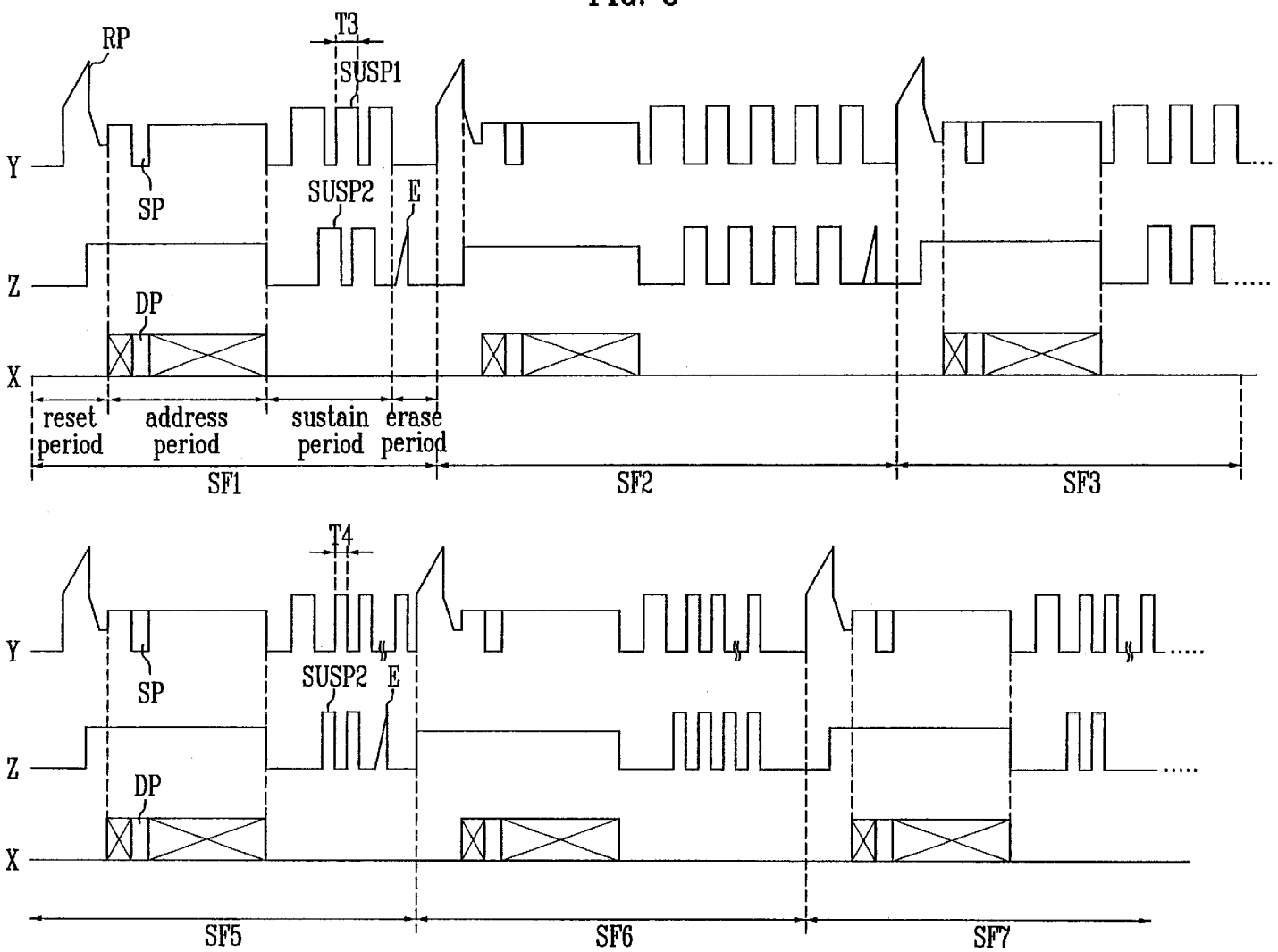
FIG. 8 illustrates waveforms for explaining a method for operating a PDP in accordance with a third preferred embodiment of the present invention.

Third, in the present invention, for the part of sub-fields to be displayed in the image of a relatively lower grey scale, the sustain pulse of a relatively lower frequency is applied to the scan electrode and the sustain electrode alternately in the sustain period of the sub-fields, and then, for the rest of the sub-fields except the sub-fields to be displayed in the image of a relatively lower grey scale, the sustain pulse of a higher frequency is applied to the scan electrode and the sustain electrode alternately in the sustain period of the sub-fields, which will be explained in detail with reference to FIG. 8.

Fourth, with regard to one frame of sub-fields in the present invention, a plurality of reset pulses are applied to the scan electrode in a reset period of a first sub-field, which will be explained in detail, with reference to FIG. 9.

Fifth, with regard to one frame of sub-fields in the present invention, the sustain pulse of a lower frequency is applied to the scan electrode and the sustain electrode in the sustain period of the first sub-field a few number of times alternately, which will be explained in detail, with reference to FIG. 10.

Figure 1:
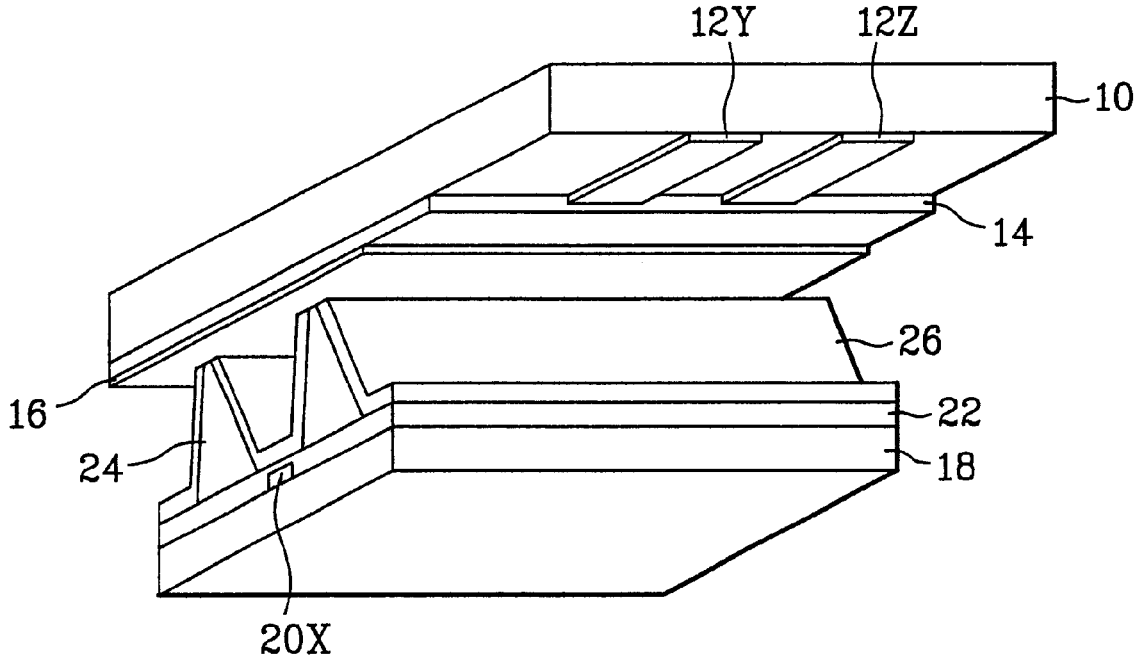
FIG. 1 Related Art
FIG. 1 illustrates a perspective view of a discharge cell of a related art AC PDP of surface discharge type having 3-electrodes.
Figure 2:
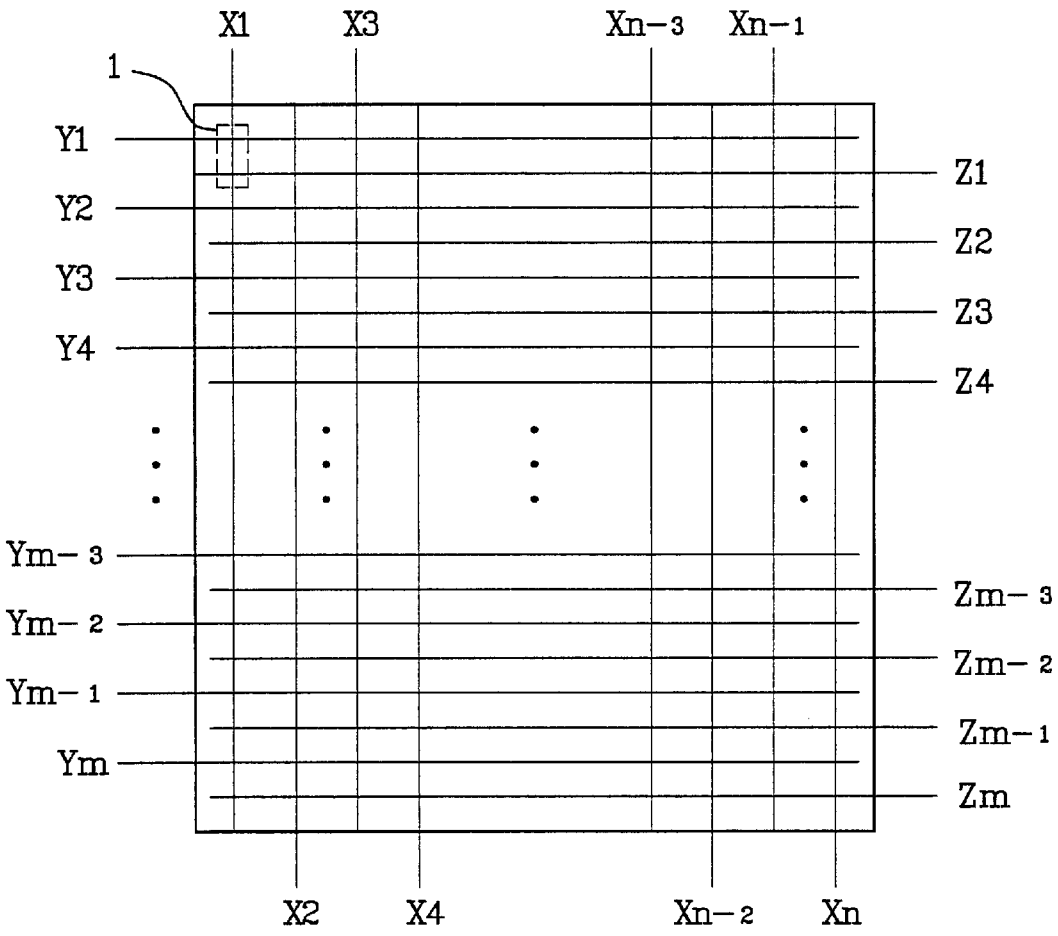
FIG. 2 Related Art
FIG. 2 illustrates a matrix of PDP discharge cells.
Figure 3:
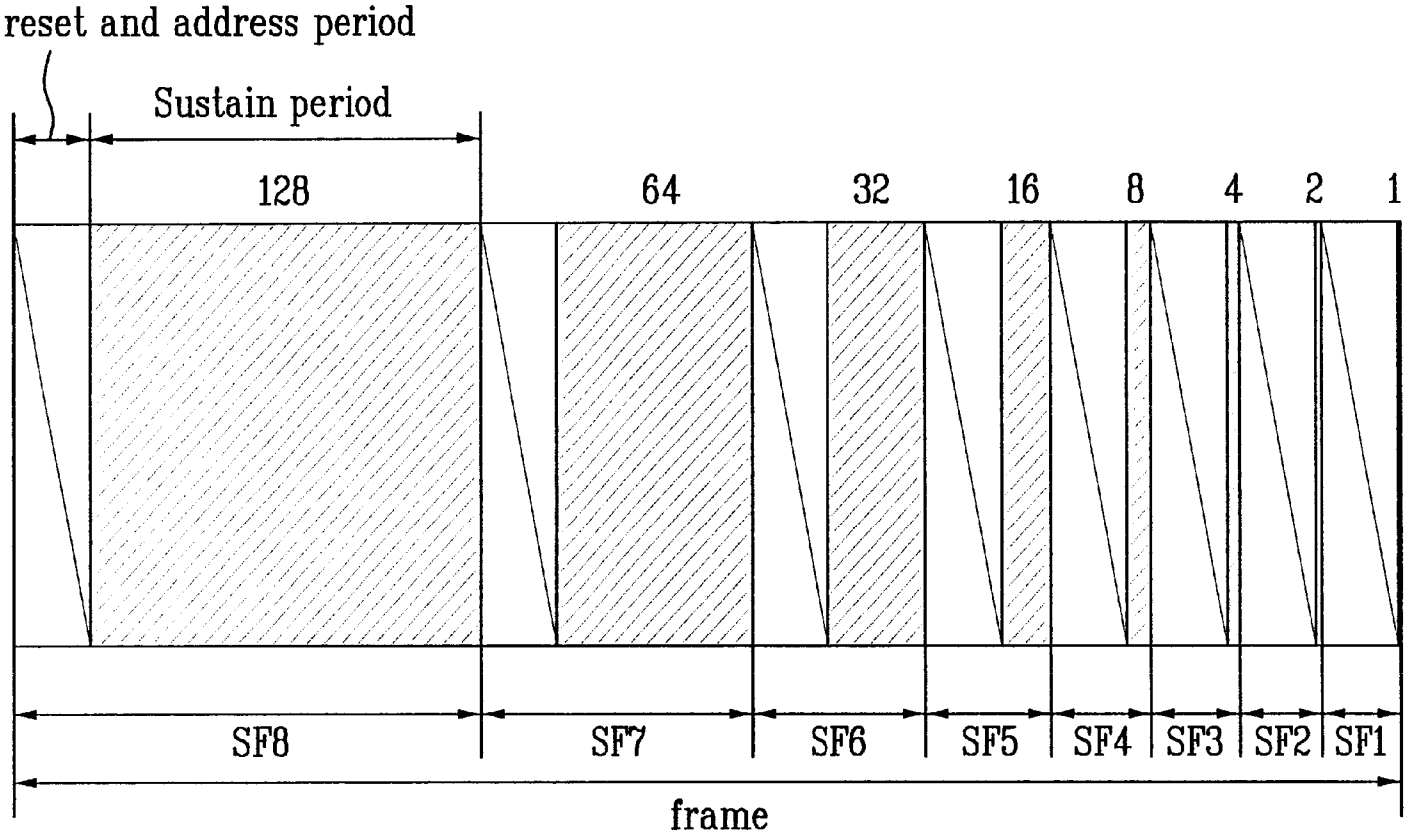
FIG. 3 Related Art
FIG. 3 illustrates a display duration of one frame displayed in 256 grey scales in a related art PDP.
Figure 4:
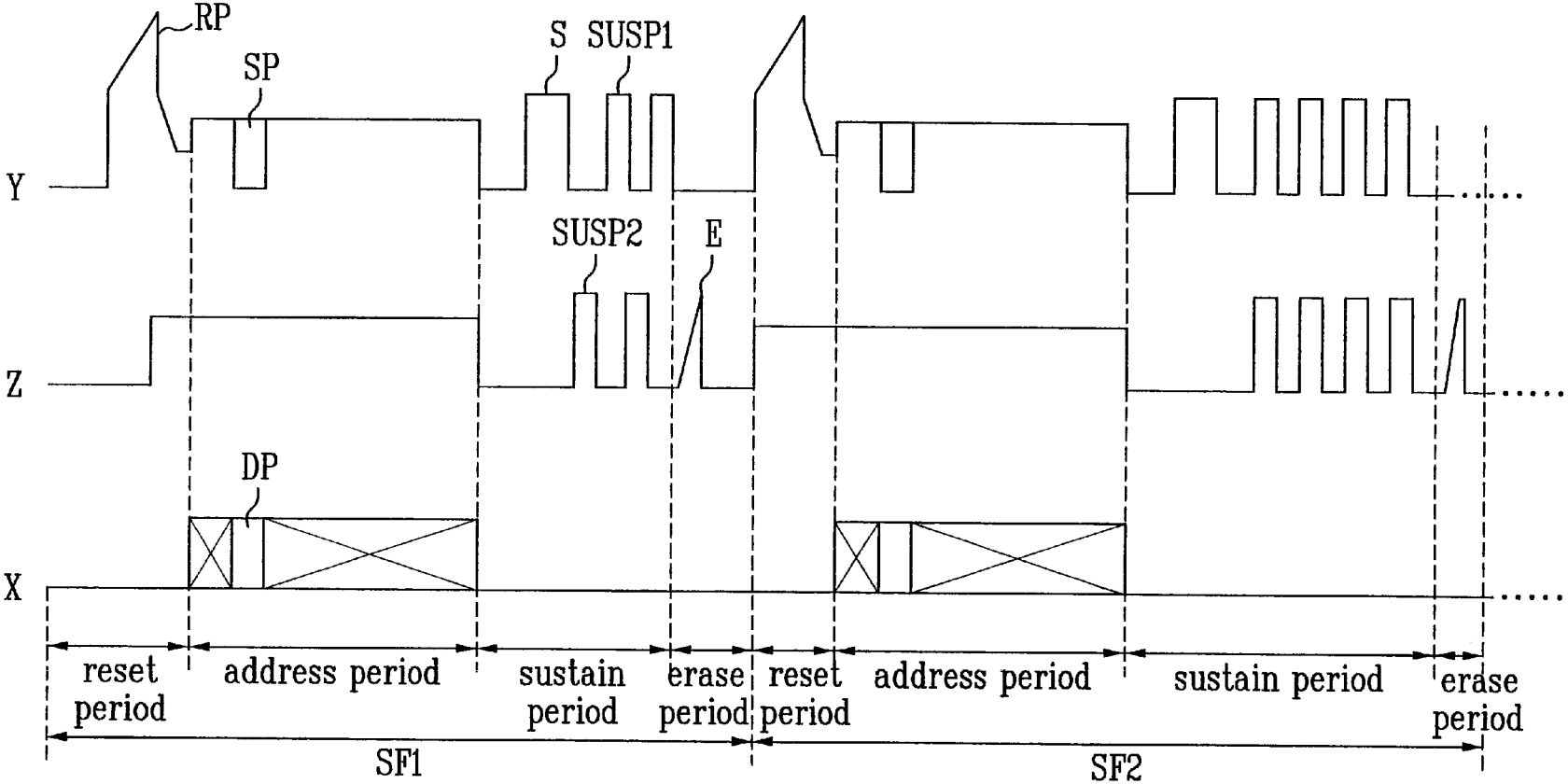
FIG. 4 Related Art
FIG. 4 illustrates operation waveforms applied to respective electrodes in each sub field in FIG. 3.
Figure 5:
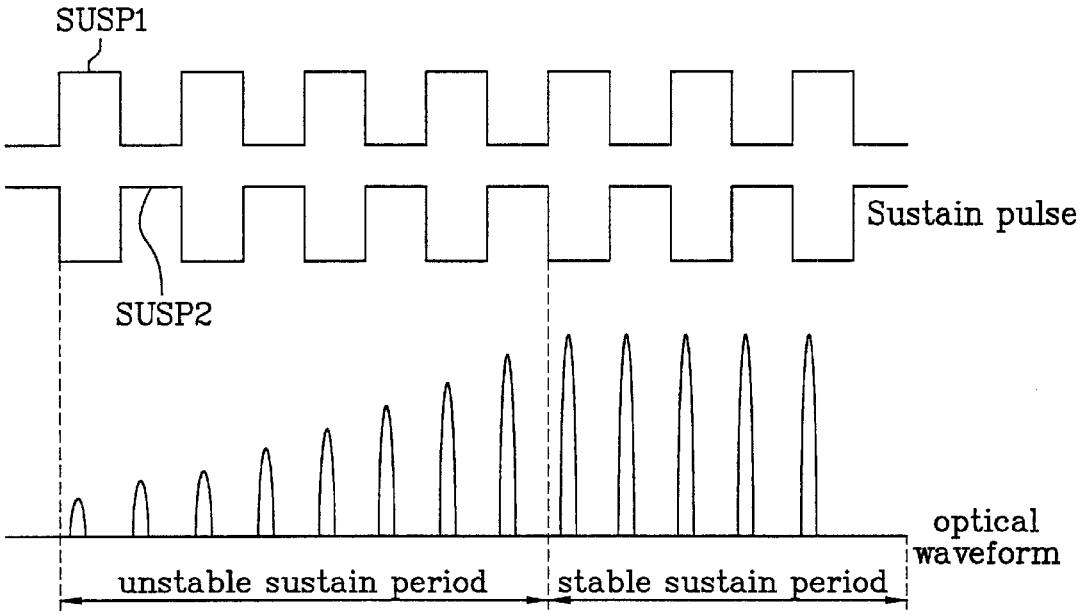
FIG. 5 Related Art
FIG. 5 illustrates optical waveforms varied with number of sustain pulses shown in FIG. 4.

Sixth, in the present invention, each pulse width of the sustain pulses SUSP1 or SUSP2 applied in the sustain period of the sub-fields of one frame is varied, of which will be explained, with reference to FIG. 1.

Preferred embodiments of the present invention will be explained, with reference to FIGS. 6–11. FIG. 6 illustrates waveforms for explaining a method for operating a PDP in accordance with a first preferred embodiment of the present invention.

In general, a period of each of the sub-fields in one frame has a reset period, an addressing period, and sustain period. A reset pulse RP is applied to a scan electrode Y to initialize all discharge cells in the reset period, the reset pulse RP is applied to the scan electrode Y in an addressing period and a data pulse DP synchronous to the reset pulse RP applied to the scan electrode Y is applied to the address electrode X, to cause an address discharge, and a sustain pulse SUSP1 or SUSP2 is applied to the scan electrode Y and the common sustain electrode Z in a sustain period alternately, to cause a sustain discharge at the discharge cells at which the address discharges are occurred for a predetermined time period.

The method for operating a PDP in accordance with a first preferred embodiment of the present invention suggests setting a scan pulse width T1 in each of the addressing periods of sub-fields (fields up to SF4) that express a lower grey scale different from a scan pulse width T2 of the sub-fields (fields after SF4). In other words, the scan pulse width T1 of the sub-fields (SF1–SF4) which are displayed in a relatively lower grey scales are set larger than the scan pulse width T2 of the sub-fields (after SF4).

For an example, if it is assumed that one frame has 12 sub-fields, the scan pulse width T1 of each of the first to fourth sub-fields SF1 to SF4 is set to be 1.8 μs, and the scan pulse width T2 of each of the fifth to twelfth sub-fields SF5 to SF12 is set to be 1.4 μs. Accordingly, the scan pulse with the 1.8 μs width is applied to the scan electrode in the addressing periods of the first to fourth sub-fields (SF1 to SF4), and the scan pulse with the 1.4 μs width is applied to the scan electrode in the addressing periods of the fifth to twelfth sub-fields (SF5 to SF12).

In the meantime, the setting of the scan pulse width T1 of the sub-fields (SF1 to SF4) to be larger results to a longer addressing period of an entire frame by approx. 700 μs, which is a time period negligible that give no great influence to the PDP operation.

In addition to this, if pulses of a frequency with 1.8 μs width is applied to the scan electrode in the addressing period of the first to fourth sub-fields (SF1 to SF4) that are to be displayed in relatively lower grey scales, the width of the scan pulse applied to the scan electrode in the addressing period of the fifth to twelfth sub-fields (SF5 to SF12) is set such that the addressing period of the entire frame is not exceeded, thereby enhancing accuracy of the PDP operation. That is, if one frame has a sequence of 12 sub-fields, pulses of a frequency with 1.8 μs width is applied to the scan electrode in each of the addressing periods of the first to fourth sub-fields (SF1 to SF4) that are to be displayed in relatively lower grey scales, and pulses of a frequency with 1.2 μs width is applied to the scan electrode in each of the addressing periods of the fifth to twelfth sub-fields (SF5 to SF12) that follow the first to fourth sub-fields, thereby securing an addressing period for one frame identical to the related art.

Thus, by setting the scan pulse width T1 of the sub-fields (SF1 to SF4) that are to be display in lower grey scales to be larger, an adequate wall charge is formed during the addressing period.

Figure 7:
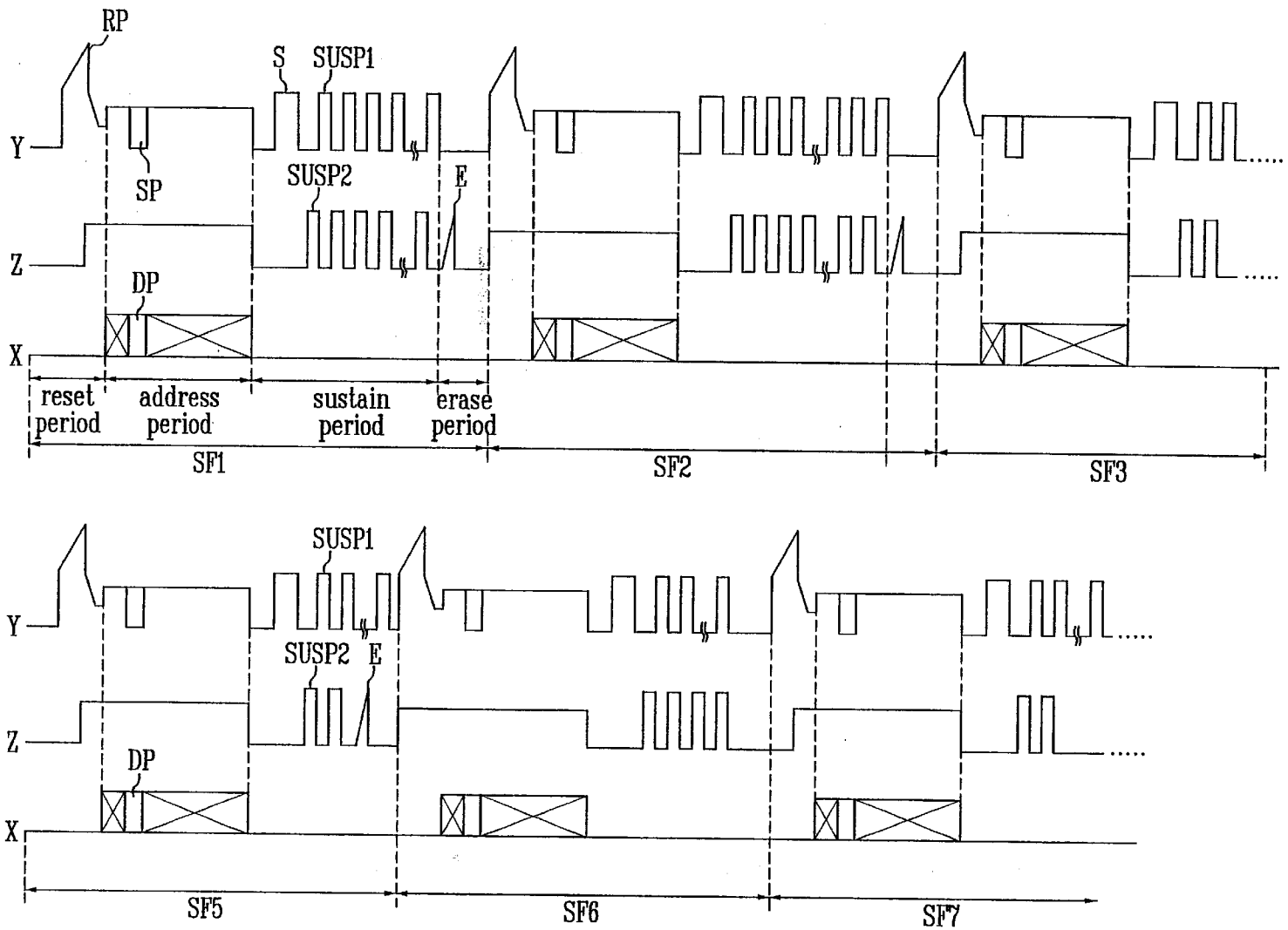
FIG. 7 illustrates waveforms for explaining a method for operating a PDP in accordance with a second preferred embodiment of the present invention.

FIG. 7 illustrates waveforms for explaining a method for operating a PDP in accordance with a second preferred embodiment of the present invention.

Referring to FIG. 7, the method for operating a PDP in accordance with a second preferred embodiment of the present invention suggests additional application of sustain pulses SUSP1, or SUSP2 more than a regular number in the sustain period of the sub-fields (SF1 to SF6) that are displayed in lower grey scales. The additional number of pulses applied to the scan electrode and the sustain electrode is fixed such that at least seven times of sustain discharge can be occurred in the sustain period. That is, at least seven times of discharge is sustained at cells selected to display images.

If it is assumed that one frame has a sequence of 12 sub-fields (SF1–SF12), five pulses are additionally applied to the scan electrode and the sustain electrode alternately in each of the sustain periods of the first to second sub-fields (SF1–SF2) that are to be displayed in images of relatively lower grey scales.

Next, pulses of a number fewer than the number of pulses applied in each of the sustain periods of the first to second sub-fields (SF1–SF2) are additionally applied in each of the sustain periods of following third and fourth sub-fields (SF3–SF4). In more detail, in the case that the five pulses are additionally applied to the scan electrode and the sustain electrode alternately in each of the sustain periods of the first to second sub-fields, four pulses are additionally applied to the scan electrode and the sustain electrode alternately in each of the sustain periods of the third to fourth sub-fields, and three pulses are additionally applied to the scan electrode and the sustain electrode alternately in each of the sustain periods of the fifth to sixth sub-fields. The number of pulses additionally applied to the third to sixth sub-fields is dependent on grey scales of the first to sixth sub-fields.

FIG. 8 illustrates waveforms for explaining a method for operating a PDP in accordance with a third preferred embodiment of the present invention.

Referring to FIG. 8, the method for operating a PDP in accordance with a third preferred embodiment of the present invention suggests setting of a width T3 of the sustain pulse of each of the sub-fields (SF1 to SF4) that are to be displayed in lower grey scales different from a width T4 of the sustain pulse of each of the sub-fields (SF5 to SF12) that are to be displayed in higher grey scales.

In more detail, the sustain pulse with a lower frequency is applied to the scan electrode and the sustain electrode in the sustain period of sub-fields (SF1 to SF4) that are to be displayed in lower grey scale images alternately, and then, the sustain pulse with a higher frequency is applied to the scan electrode and the sustain electrode in the sustain period of the rest sub-fields (SF5 to SF12) except the sub-fields (SF1–SF4) that are to be displayed in low grey scale images, alternately. That is, the sustain pulse width T3 of each of the sub-fields (SF1–SF4) that are to be displayed in lower grey scale images is set to be larger than the sustain pulse width T4 of the sub-fields (SF5–SF12) that are to be displayed in higher grey scale images.

For an example, if a frequency of the sustain pulse to be displayed in a higher grey scale is 200 KHZ, a frequency of the sustain pulse to be displayed in a lower grey scale is 100 KHZ.

Thus, by setting the frequency of the sub-fields (SF1–SF4) to be displayed in lower grey scale is set lower, the erratic discharge in the sustain period is prevented.

Figure 9:
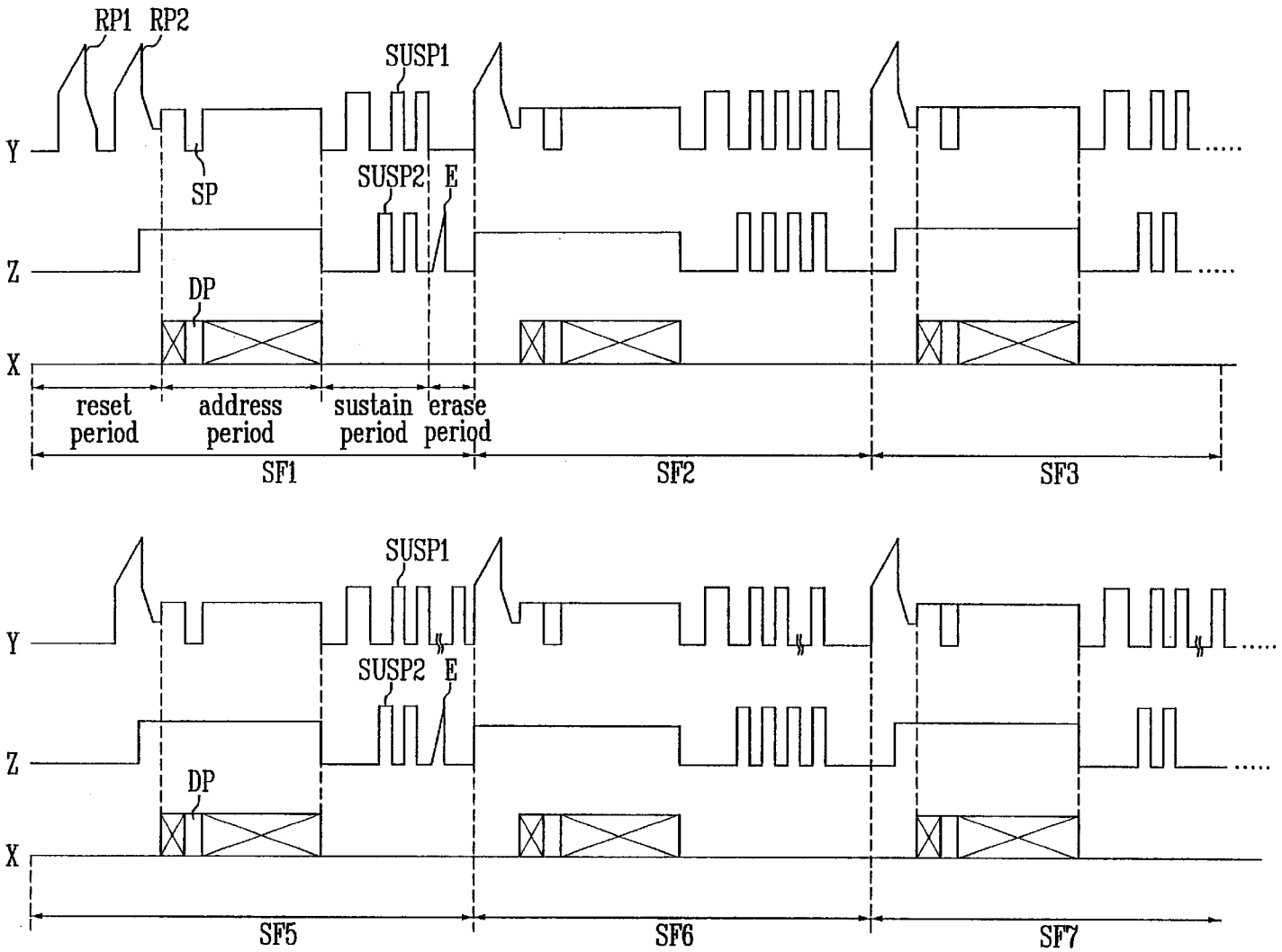
FIG. 9 illustrates waveforms for explaining a method for operating a PDP in accordance with a fourth preferred embodiment of the present invention.

FIG. 9 illustrates waveforms for explaining a method for operating a PDP in accordance with a fourth preferred embodiment of the present invention.

Referring to FIG. 9, the method for operating a PDP in accordance with a fourth preferred embodiment of the present invention suggests application of a plurality of reset pulses to the scan electrode in a reset period of a first sub-field (SF1) among one frame of sub-fields.

In detail, two pulses RP1, and RP2 are applied to the reset period in the first sub-field (SF1). As shown in FIG. 9, if two reset pulses RP1, and RP2 are applied in reset period of the first sub-field (SF1), an adequate wall charge can be formed in the reset period. The wall charge formed in the reset period adequately permits to form an adequate wall charge by a voltage lower than the time of address discharge.

Figure 10:
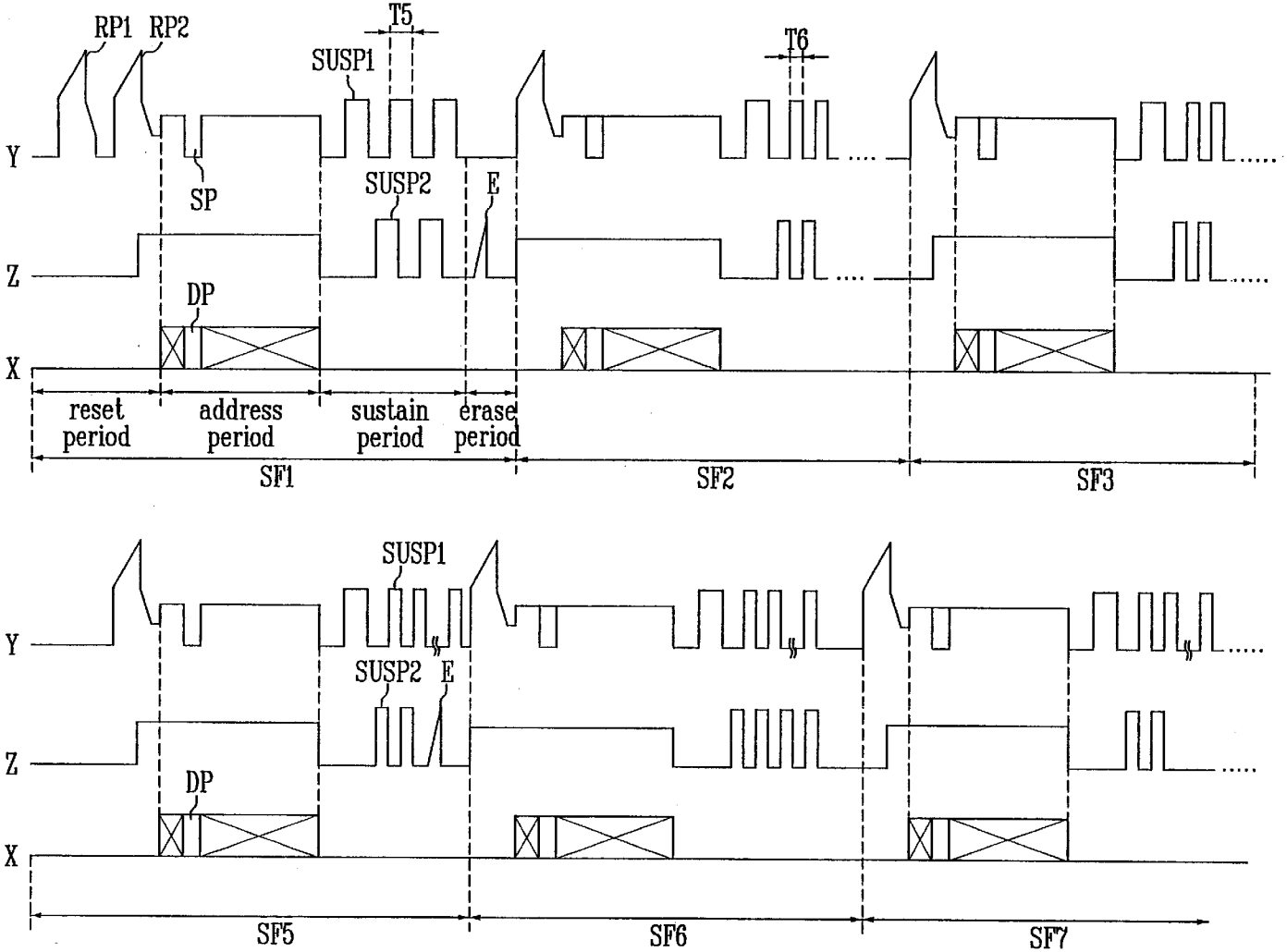
FIG. 10 illustrates waveforms for explaining a method for operating a PDP in accordance with a fifth preferred embodiment of the present invention; and, FIG. 11 illustrates waveforms for explaining a method for operating a PDP in accordance with another preferred embodiment of the present invention.

FIG. 10 illustrates waveforms for explaining a method for operating a PDP in accordance with a fifth preferred embodiment of the present invention.

Referring to FIG. 10, the method for operating a PDP in accordance with a fourth preferred embodiment of the present invention suggests respective application of the sustain pulses SUSP1 and SUSP2 of a lower frequency to the scan electrode and sustain electrode alternately in the sustain period of the first sub-field (SF1) among one frame of sub-fields for a few times, and then respective application of the sustain pulses SUSP1 and SUSP2 of a higher frequency to the scan electrode and sustain electrode alternately in the sustain period of each of the second to twelfth sub-fields (SF2–SF12) among one frame of sub-fields for a few times.

That is, all the widths T5 of the sustain pulses SUSP1 and SUSP2 of the first sub-field SF1 are set the same. In more detail, the width T5 of the sustain pulse SUSP1 or SUSP2 of the first sub-field (SF1) is set to be 3–10 $\mu$s.

Figure 11:
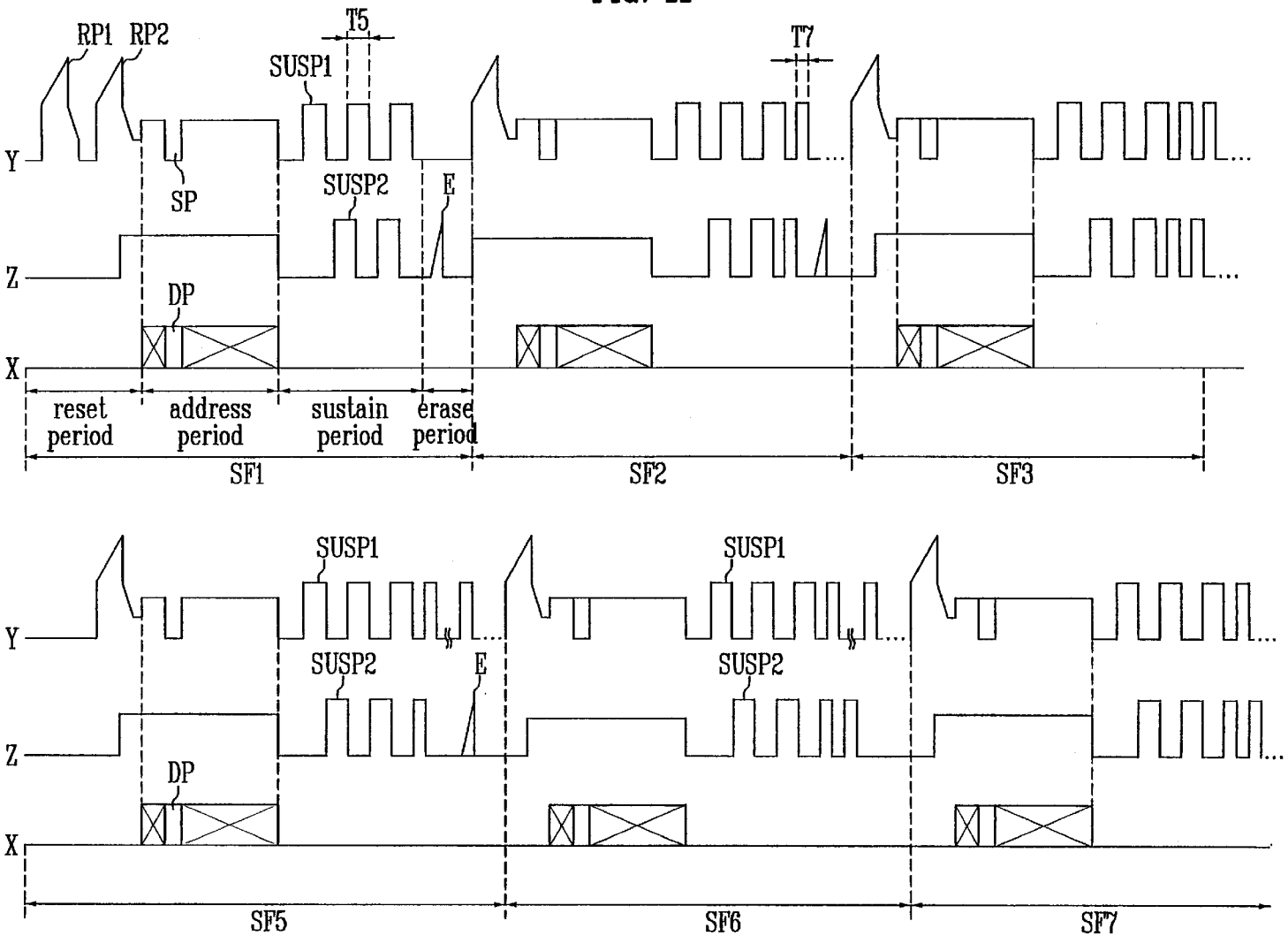

FIG. 11 illustrates waveforms for explaining a method for operating a PDP in accordance with another preferred embodiment of the present invention.

Referring to FIG. 11, the method for operating a PDP in accordance with a fourth preferred embodiment of the present invention suggests setting a width T5 of sustain pulse SUSP1 or SUSP2 applied at an initial sustain period of all sub-fields SF1 to SF12 in one frame is larger than a width T7 of sustain pulse SUSP1 or SUSP2 applied after the initial sustain period of all sub-fields SF1 to SF12 in one frame.

That is, of the plurality of sustain pulses applied in the sustain period of any sub-fields, the first pulse applied initially is set to be a lower frequency, and a second pulse applied thereafter is set to be a higher frequency.

Thus, of the plurality of sustain pulses of all the sub-fields (SF1–SF12), by setting the width of the initially applied pulse of the sustain pulse SUSP1 or SUSP2 to be larger, the erratic sustain discharge can be prevented.

As has been explained, the method for operating a PDP of the present invention can stabilize sustain periods of sub-fields displaying relatively lower grey scale images without employing a separate drive IC.

The stabilization of the sustain period can prevent an error of the sustain discharge and deterioration of the picture because an adequate luminance is available even if an image of a lower grey scale is displayed.

It will be apparent to those skilled in the art that various modifications and variations can be made in the method for operating a PDP of the present invention without departing from the spirit or scope of the invention. Thus, it is intended that the present invention cover the modifications and variations of this invention provided they come within the scope of the appended claims and their equivalents.

What is claimed is:

1. A method for operating a PDP having three electrodes, the PDP for displaying one frame which includes a plurality of sub-fields each having a reset period, an addressing period, and a sustain period in view of time, the method comprising the steps of:

applying a fixed number of pulses in a fixed frequency in each period for displaying an image of a particular grey scale; and adjusting a number of pulses and/or a frequency applied in each period for displaying an image having a grey scale different from the particular grey scale.

2. A method as claimed in claim 1, wherein, for a part of sub-field (A) to be displayed in a lower grey scale image, pulses of a lower frequency are applied to a scan electrode in the addressing period of the sub-fields (A).

3. A method as claimed in claim 1, wherein, a pulse with a 1.8 μs width is applied to the scan electrode in the addressing period of the sub-fields (A).

4. A method as claimed in claim 2, wherein, for the rest of sub-fields (B) except the part of sub-field (A) of a lower grey scale, pulses of a higher frequency than the sub-field (A) are applied to the scan electrode in the addressing period of the sub-fields (B).

5. A method as claimed in claim 4, wherein, as a pulse of a frequency with a 1.8 μs width is applied to the scan electrode in the addressing period of the sub-fields (A), a pulse of a frequency with a 1.4 μs width is applied to the scan electrode in the addressing period of the sub-fields (B).

6. A method as claimed in claim 5, wherein, as a pulse of a frequency with a 1.8 μs width is applied to the scan electrode in the addressing period of the sub-fields (A), a width of the pulse to be applied in the addressing period of the rest sub-fields (B) is fixed such that a fixed addressing period of the entire frame is not exceeded.

7. A method as claimed in claim 1, wherein, when the frame has a sequence of 12 sub-fields, a pulse of a frequency with a 1.8 μs width is applied to the scan electrode in each of the addressing periods of the first to fourth sub-fields that are to be displayed in lower grey scale images.

8. A method as claimed in claim 7, wherein a pulse of a frequency with a 1.4 μs width is applied to the scan electrode in each of the addressing periods of the fifth to twelfth sub-fields following the first to fourth sub-fields.

9. A method as claimed in claim 7, wherein a pulse of a frequency with a 1.2 μs width is applied to the scan electrode in each of the addressing periods of the fifth to twelfth sub-fields following the first to fourth sub-fields.

10. A method as claimed in claim 1, wherein, for a part of sub-fields (A) to be displayed in a relatively lower grey scale image, a number of pulses more than a regular number are applied to the scan electrode and the sustain electrode alternately in the sustain period of the sub-fields (A).

11. A method as claimed in claim 10, wherein a number of pulses alternately applied to the scan electrode and the sustain electrode respectively is fixed such that at least seven times of discharges are sustained in cells selected to display images.

12. A method as claimed in claim 11, wherein, when the frame has a sequence of 12 sub-fields, additional five pulses are respectively applied to the scan electrode and the sustain electrode alternately in each of sustain periods of the first to second sub-fields that are to be displayed in lower grey scale images.

13. A method as claimed in claim 12, wherein a number of pulses fewer than a number of pulses applied to each of sustain periods of the first to second sub-fields are applied to the sustain periods of the following third to fourth sub-fields additionally.

14. A method as claimed in claim 13, wherein, in the case additional five pulses are respectively applied to the scan electrode and the sustain electrode alternately in each of sustain periods of the first to second sub-fields, additional four pulses are respectively applied to the scan electrode and the sustain electrode alternately in each of sustain periods of the third to fourth sub-fields.

15. A method as claimed in claim 13, wherein a number of additional pulses fewer than a number of pulses applied to each of the sustain period of the third to fourth sub-fields are respectively applied to the scan electrode and the sustain electrode in each of the sustain periods of the fifth to sixth sub-fields.

16. A method as claimed in claim 15, wherein, in the case additional five pulses are respectively applied to the scan electrode and the sustain electrode alternately in each of sustain periods of the first to second sub-fields, and additional four pulses are respectively applied to the scan electrode and the sustain electrode alternately in each of sustain periods of the third to fourth sub-fields, additional three pulses are respectively applied to the scan electrode and the sustain electrode alternately in each of the sustain periods of the fifth to sixth sub-fields.

17. A method as claimed in claim 16, wherein a number of pulses additionally applied in the third to sixth sub-fields are dependent on grey scales of images of the first to sixth sub-fields.

18. A method as claimed in claim 1, wherein, for a part of sub-fields (A) to be displayed in relatively lower grey scale images, pulses of a lower frequency are applied to the scan electrode and the sustain electrode alternately in the sustain period of the sub-fields (A).

19. A method as claimed in claim 1, wherein, of the sub-fields of the frame, pulses of a lower frequency are respectively applied to the scan electrode and the sustain electrode a few times alternately in the sustain period of the first sub-field.

20. A method as claimed in claim 19, wherein pulses of a frequency with a 3–10 μs width are respectively applied to the scan electrode and the sustain electrode a few times alternately in the sustain period of the first sub-field.

21. A method as claimed in claim 1, wherein, of the sub-fields of the frame, a plurality of pulses are applied to the scan electrode in the reset period of the first sub-field.

22. A method as claimed in claim 21, wherein two pulses are applied to the scan electrode in the reset period of the first sub-field.

23. A method as claimed in claim 1, wherein, for any one sub-field in the frame, a frequency of one or more than one pulse applied initially to the scan electrode and the sustain electrode in the sustain period of the any one field is set to be relatively lower than a frequency of one or more than one pulse applied, thereafter.

* * * * *